US012778257B2

(12) United States Patent
Hadari et al.

(10) Patent No.: US 12,778,257 B2
(45) Date of Patent: Nov. 3, 2026

(54) ADJUSTABLE TENSION HAIRSTYLING TOOL

(71) Applicant: L'ANGE HAIR, INC., Chatsworth, CA (US)

(72) Inventors: Amnon Hadari, Dania Beach, FL (US); John Maurer, Dania Beach, FL (US); Daniel Prindle, Dayton, OH (US); Wei Jin Tay, Centerville, OH (US)

(73) Assignee: L'ANGE HAIR, INC., Chatsworth, CA (US)

( * ) Notice: Subject to any disclaimer, the term of this patent is extended or adjusted under 35 U.S.C. 154(b) by 0 days.

(21) Appl. No.: 19/087,158

(22) Filed: Mar. 21, 2025

(65) Prior Publication Data

US 2026/0283320 A1 Sep. 24, 2026

(51) Int. Cl.
*A45D 1/04* (2006.01)
*A45D 1/00* (2006.01)
*A45D 2/00* (2006.01)

(52) U.S. Cl.
CPC ..... *A45D 1/04* (2013.01); *A45D 2/001* (2013.01); *A45D 2001/004* (2013.01)

(58) Field of Classification Search
CPC .... A45D 1/04; A45D 2/001; A45D 2001/004; A45D 1/06; A45D 1/08; A45D 1/12; A45D 2001/002
(Continued)

(56) References Cited

U.S. PATENT DOCUMENTS 1,696,932 A * 1/1929 Wolcott ..... A45D 1/04 132/232
4,192,328 A * 3/1980 Barradas ..... A45D 1/04 219/242
(Continued)

FOREIGN PATENT DOCUMENTS

CN 111035136 A * 4/2020 ..... A45D 6/00
CN 114158834 A * 3/2022 ..... A45D 1/06
(Continued)

OTHER PUBLICATIONS

Yong Xiao, "CN_111035136_A_translated" (Year: 2020).*
(Continued)

*Primary Examiner* — Rachel R Steitz
*Assistant Examiner* — Holly T. To
(74) *Attorney, Agent, or Firm* — Sheppard, Mullin, Richter & Hampton LLP

(57) ABSTRACT

A hairstyling tool may include: a body; a first prong extending from the body in a first direction and being pivotally attached to the body portion via a hinge; a second prong extending from the body portion in the first direction; a double torsion spring comprising first and second torsion springs connected by a bridge and positioned to apply pressure on a proximal end of the first prong; and an inclined plane movable longitudinally, which when moved to a forward position, moves relative to the bridge to position the bridge in a detent, and spring tension is at a first amount; and when the inclined plane moves rearward, it moves relative to the bridge to position the bridge in a groove and spring tension is at a second amount; wherein the second amount of spring tension is greater than the first amount of spring tension.

19 Claims, 11 Drawing Sheets

(58) Field of Classification Search
USPC ..... 132/232
See application file for complete search history.

(56) References Cited

U.S. PATENT DOCUMENTS 5,223,694 A * 6/1993 Tsuji ..... A45D 1/04 132/118
5,354,967 A * 10/1994 Barzilai ..... G05D 23/1909 219/241
6,029,677 A * 2/2000 Nanba ..... A45D 1/04 132/228
6,895,975 B2 * 5/2005 Hafemann ..... A45D 20/12 132/224
6,920,886 B2 * 7/2005 McCambridge ..... A45D 2/001 132/232
7,044,139 B2 * 5/2006 Tong ..... A45D 1/16 132/232
7,730,895 B2 * 6/2010 Maddocks ..... A45D 1/06 132/224
8,082,929 B2 * 12/2011 Kim ..... A45D 1/04 132/223
8,342,191 B2 * 1/2013 Ragosta ..... A45D 7/02 132/211
8,967,160 B2 * 3/2015 Kim ..... A45D 6/045 132/232
9,232,839 B2 * 1/2016 Hein ..... A45D 1/28
10,258,132 B2 * 4/2019 Leung ..... A45D 2/001
12,402,702 B2 * 9/2025 Hillebrecht ..... A45D 1/00
2005/0121050 A1 * 6/2005 Cha ..... A45D 1/04 132/229
2009/0032048 A1 * 2/2009 Suzuki ..... A45D 2/001 132/227
2010/0083978 A1 * 4/2010 Hottenrott ..... A45D 1/06 132/211
2011/0203606 A1 * 8/2011 Recchion ..... A45D 1/04 132/269
2012/0111357 A1 * 5/2012 Amkie ..... A45D 1/08 132/238
2013/0074866 A1 * 3/2013 Liao ..... A45D 1/02 132/271
2013/0199561 A1 * 8/2013 Schlough ..... A45D 1/04 132/211
2015/0223582 A1 * 8/2015 Pedroarena ..... A45D 1/04 34/97
2016/0374445 A1 * 12/2016 Cho ..... A45D 1/10 132/232
2020/0069021 A1 * 3/2020 Lin ..... A45D 1/04
2022/0053902 A1 * 2/2022 Siu ..... A45D 1/02

FOREIGN PATENT DOCUMENTS

CN 118303709 A * 7/2024 ..... A45D 1/28
KR 20170031555 A * 3/2017 ..... A45D 1/08

OTHER PUBLICATIONS

Xia-gang Song, "CN_114158834_A_I_translated" (Year: 2022).*
Guo-hong Fang, "CN_118303709_A_I_translated" (Year: 2024).*
Noh Tae Hyung, "KR_20170031555_A_I_translated" (Year: 2017).*

* cited by examiner

ADJUSTABLE TENSION HAIRSTYLING TOOL

TECHNICAL FIELD

The present disclosure relates generally to hairstyling tools, and in particular, some implementations may relate to a hairstyling tool with adjustable spring tension.

DESCRIPTION OF RELATED ART

Hairstyling tools, such as irons, wands and other devices, for curling, flattening, straightening, waving and otherwise treating hair, have been around for centuries. Early styling devices were rudimentary and consisted of metal rods that were heated over open flames, hot stones, or other heat source. As electricity became more widespread, electric curling irons began to appear. These devices were more reliable and easier to control than their flame-heated predecessors.

Modern hair devices include two-prong designs and feature advanced technologies such as tourmaline, titanium, and ionic technology, which help reduce frizz and enhance shine. More recently, designs have evolved to include adjustable temperature settings, ergonomic designs, and safety features.

BRIEF SUMMARY OF THE DISCLOSURE

According to various embodiments of the disclosed technology a hairstyling tool includes a body portion that may form a handle. It may include a first prong that extends in a first direction, which may include a temperature-controlled element and an elongate aperture on its top surface. This prong may be pivotally attached to the body via a hinge. A second prong also extends from the body portion. The tool utilizes a double torsion spring, which comprises first and second torsion springs wound around a common axis and connected by a bridge. This spring may be strategically positioned to apply pressure on the proximal end of the first prong, maintaining it in a closed position relative to the second prong. Each leg of the torsion spring may rest in a corresponding spring mounting channel in the base of the body portion.

The tool may include a tension adjustment actuator. This includes a main body portion with a ramp portion featuring an inclined plane surface. The ramp portion also includes a detent at the lower end and a groove at the top end. The bridge of the double torsion spring interacts with this ramp to adjust spring tension. By moving the post to the rearward position, the ramp is translated longitudinally, causing the bridge to rise along the inclined plane and settle in the groove, thereby increasing spring tension. Conversely, moving the post to the forward position places the bridge in the detent, reducing spring tension.

Additionally, the tool may include first and second parallel elongate members that extend in a spaced-apart relation from the main body portion and featuring grooves that form a latch. The forward ends of these elongate members may be chamfered. A locking pin designed to engage with this latch may be situated on the inner surface of the first prong. When the post is slid rearward sufficiently, the chamfered edges of the elongate members contact the locking pin, causing them to spread apart and accept the locking pin between them, ultimately engaging it within the latch. The locking pin can be either a cylindrical post or a ball. Furthermore, the detent at the lower end of the ramp portion may include a level surface adjacent to a lip or radiused lip, facilitating the retention of the desired tension setting.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Some of the figures included herein illustrate various embodiments of the disclosed technology from different viewing angles. Although the accompanying descriptive text may refer to such views as "top," "bottom" or "side" views, such references are merely descriptive and do not imply or require that the disclosed technology be implemented or used in a particular spatial orientation unless explicitly stated otherwise. Likewise, description of components or assemblies as moving "up," "down," "forward" or "rearward," or of "top," "bottom," "front" and "rear" surfaces, and so on, likewise does not imply or require that the disclosed technology be implemented or used in a particular spatial orientation unless explicitly stated otherwise.

FIG. 3, which comprises

FIG. 9, which comprises

FIG. 10, which comprises

FIG. 11, which comprises

Figure 1:
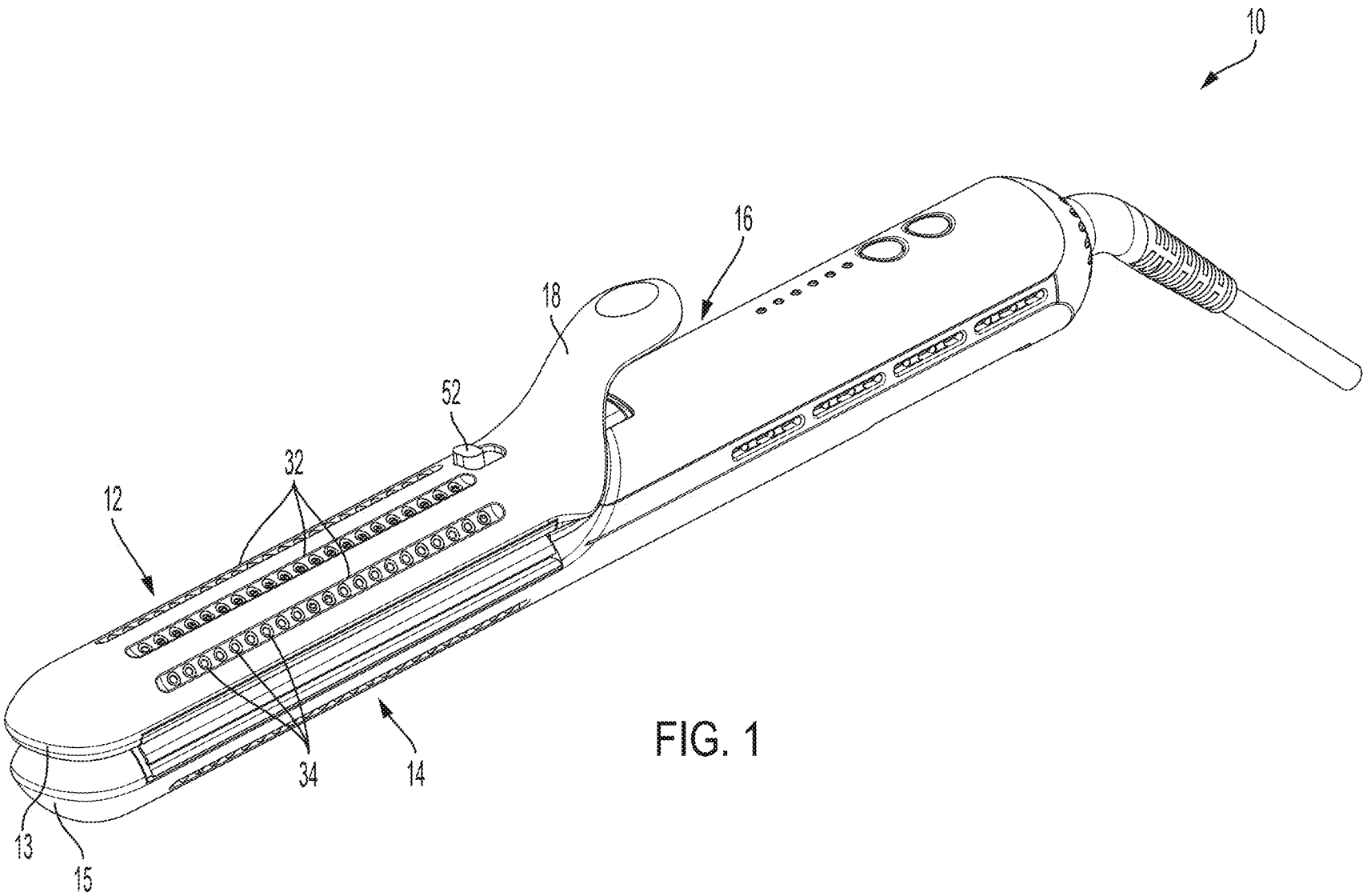
FIG. 1 illustrates an example hairstyling tool in accordance with various aspects of the disclosure.

The figures are not exhaustive and do not limit the present disclosure to the precise form disclosed.

DETAILED DESCRIPTION

Embodiments of the systems and methods disclosed herein can provide a hairstyling device with a spring-operated closure that includes an adjustable tensioner to adjust tension applied by the spring. This allows the user to adjust the clamping force applied by the hairstyling device during hairstyling operations. Such a mechanism is useful, for example, for 2-prong hairstyling tools. A two-prong hairstyling tool typically includes two elongated, parallel plates or rods that can be heated or cooled to various temperatures. The two-prong design allows the user to clamp a section of hair between the temperature-controlled surfaces, providing even heat distribution for efficient styling. When used to straighten hair, the tool is gently pulled along the length of the hair shaft from root to tip, smoothing out waves and curls. Conversely, to create curls or waves, the hair is wrapped around one or both of the temperature-controlled prongs and held in place for a few seconds before being released, resulting in a defined curl. Two-prong hairstyling tools often feature advanced materials such as ceramic, titanium or tourmaline plates, which help to reduce frizz, and enhance shine. These devices often also include adjustable temperature settings and safety features like automatic shut-off, making them suitable for various hair types and ensuring safe usage.

Spring tension in two-prong devices is used to ensure that the plates or rods maintain pressure on the hair, which can be important for achieving uniform styling results. This mechanism involves a spring-loaded hinge on either or both prongs, holding them together, but allowing a user to open them, usually by depressing a thumb lever. When a user clamps a section of hair between the prongs, the spring tension provides a grip on the hair, preventing the hair from slipping out while enabling smooth movement along the hair shaft. This pressure helps to evenly distribute heat across the hair, minimizing hot spots and reducing the risk of damage.

Spring tension can be provided by any of a number of different types of spring or spring-like mechanisms. For example, a spring may include a coil spring, torsion spring, leaf spring, V spring and so on.

Various embodiments disclosed herein include a tension-adjustment mechanism to allow the user to select the amount of force applied by the plates to the hair. This adjustability may be beneficial for users with different hair types or those who prefer varying levels of grip pressure during styling. In various embodiments, an adjustment mechanism, such as, for example, a dial or switch or other mechanism, can be provided to increase or decrease the pressure placed on the plates or rods by the spring mechanism. This customization enables users to select a lighter tension (e.g., for fine or damaged hair, minimizing potential stress and breakage) or a heavier tension (e.g., for thicker or coarser hair). Also, a stronger tension setting can provide a more secure grip, ensuring that the hair is styled effectively in fewer passes (and sometimes in one pass), depending on the conditions.

The apparatus and methods disclosed herein may be implemented with any of a number of different types and configurations of hairstyling tools. An example hairstyling tool in which embodiments of the disclosed technology may be implemented is illustrated and described with respect to FIGS. 1 and 2. After reading this description, one of ordinary skill in the art will understand how to implement the adjustable tension apparatus in other hairstyling tools.

FIG. 1 illustrates an example hairstyling tool in accordance with various aspects of the disclosure. With reference now to FIG. 1, in this example, hairstyling device 10 includes a main body configured as a handle 16, and a pair of prongs 12, 14 extending from a distal end of handle 16. In this example, prong 14 is a fixed extension of the lower portion of handle 16 and is an integral part of handle 16. Also in this example, prong 12 is a separate component from, but is attached to handle 16 via a hinge 42 to permit movement of prong 12 relative to handle 16 and prong 14. In other implementations, prong 14 may be a separate component from handle 16 and may also be attached to handle 16 in a hinged or fixed manner.

A lever 18 is included in this example and extends from a proximal end of prong 12 toward and over handle 16. Lever 18 may be a separate component from, and attached to, prong 12, or lever 18 may be an integral extension of prong 12 (e.g., molded in a single mold). Lever 18 may be provided to allow the user to open prong 12 by applying pressure on lever 18. In the illustrated example, lever 18 is curved upward to allow the user to apply such pressure in a downward (relative to the orientation in the drawing) with their finger (e.g., with their thumb).

Although not illustrated in FIG. 1, a spring mechanism can be provided at hinge 42 and can be biased such that prong 12 is in the normally closed position such as is shown in FIG. 1. Accordingly, after the user presses on lever 18 and opens prong 12, upon the user releasing lever 18, prong 12 may spring back to a normally closed position allowing prong 12 to clamp hair between both prongs 12, 14.

Figure 2:
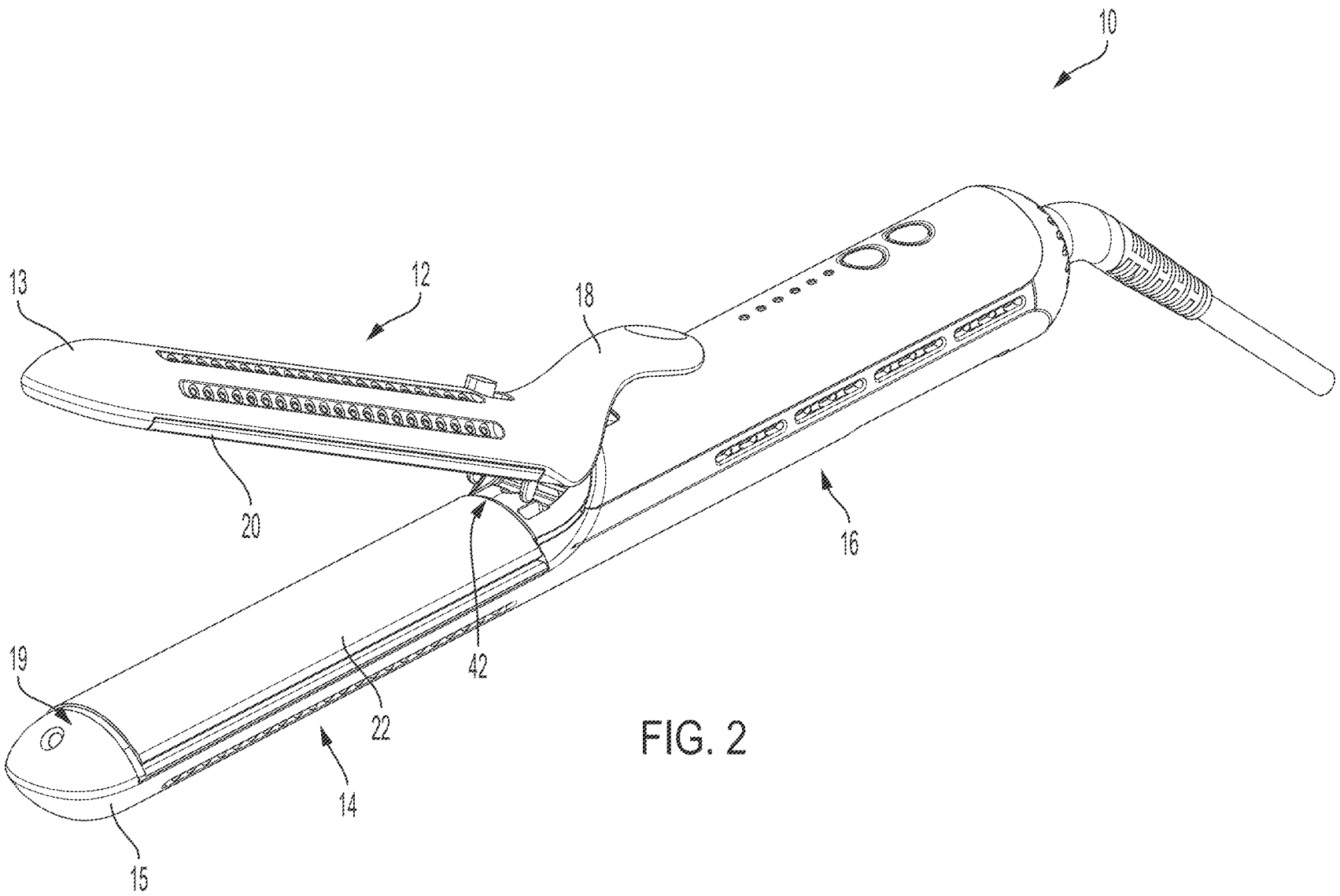
FIG. 2 illustrates the example hairstyling tool of FIG. 1 in an opened position in accordance with various aspects of the disclosure.

FIG. 2 illustrates the example hairstyling tool of FIG. 1 in an opened position in accordance with various aspects of the disclosure. Referring now to FIGS. 1 and 2, in this example, prongs 12 and 14 have inward-facing surfaces 20, 22, respectively. According to various aspects, either or both inward-facing surfaces 20, 22 constitute or include plates that may be heated above ambient temperature to a determined temperature via heating elements (not shown), or cooled below ambient temperature to a determined temperature via cooling elements (not shown). Inward-facing surfaces 20, 22 may be made from materials that are relatively efficient at radiating the hot or cold temperatures from the plates to the hair such as, for example, metals and alloys (e.g., stainless steel, steel alloys, manganese, copper-bronze, nickel, iron or iron alloys, titanium, etc.), ceramics, metal ceramics, tourmaline, and other materials.

As seen in the example of FIGS. 1 and 2, the plates that make up inward-facing surfaces 20, 22, extend partially around the sides of prongs 12 and 14 of the hairstyling device such that they are exposed on the sides. This is in contrast to other embodiments that may have inward-facing surfaces 20, 22 extending only to within the outer perimeter of prongs 12 and 14, or only to the outer perimeter itself. Other implementations may include inward-facing surfaces 20, 22 that extend fully around the sides of prongs 12 and 14. Including inward-facing surfaces 20, 22 that extend at least partially around the sides of prongs 12 and 14 can allow for a smoother transition of the hair onto the surfaces and may reduce catching or snagging of the hair on edges of the inward-facing surfaces 20, 22.

The example of FIG. 1 includes tips at distal ends 13, 15 of the prongs 12, 14 that are not temperature controlled. In the example of FIG. 2, tips at distal ends 13, 15 of the prongs 12, 14 may include temperature-controlled facing surfaces, creating a temperature controlled quadraspherical tip at distal ends 13, 15 on each prong 12, 14.

In the illustrated example, the outer surfaces of prongs 12 and 14 include rows 32 of openings 34. In various embodiments, heated, cooled, or ambient air (or other fluid) can be blown through openings 34 as part of the styling process. One or more blower motors may be provided (e.g., within handle 16) to move air through ducts or channels through the device and out through openings 34. Air may be heated or cooled separately, or it may be passed by heating or cooling elements of the styling device 10 to heat or cool the air.

This example includes four rows of openings on each outer surface of the prongs 12, 14. In other applications, other quantities of rows and openings can be provided, as can other arrangements of rows and openings. Openings in this example are circular, but in other implementations they may be elongated, squared or of other geometries.

In some applications, according to various aspects, outer surfaces of the prongs may include plates and corresponding heating or cooling elements (not shown) such that they may be heated above ambient temperature to a determined temperature via heating elements (not shown), or be cooled below ambient temperature to a determined temperature via cooling elements (not shown).

The outer surfaces of prongs 12, 14 in this example are arcuate, providing a cylindrical cross section that is approximately circular in cross section when prongs 12, 14 are joined together. Other examples may use a cylindrical cross section that is elliptical in form when prongs 12, 14 are closed. The shape might be useful, for example, for curling hair. The outer surfaces of prongs 12, 14 may be smooth surfaces, or may have textures such as ridges, dimples, bumps, waves and so on. In this example, rows 32 are shown as recessed features running longitudinally along the outer surfaces of prongs 12, 14. Additionally, the outer surfaces of prongs 12, 14 can include orifices through which fluid (such as temperature-controlled air) may pass as described above. As noted above, the outer surfaces of prongs 12, 14 can include temperature-controlled portions to provide heating or cooling to the hair.

In this example, inward-facing surfaces 20, 22 are curved in a complementary fashion (one being convex and the other concave) to add to the performance of the styling device. In other implementations, inward-facing surfaces 20, 22 may be of other shapes and dimensions, including flat, wavy, and so on, depending on the desired outcome. In some implementations, the surfaces 20, 22 may be interchangeable so that the user can select from among various shapes and geometries of inward facing surfaces 20, 22.

This example also illustrates that distal ends 13, 15 of prongs 12, 14, respectively, are tapered inward from the tip due to the quadraspherical nature of the inner surface of the tips in this example. Distal ends 13, 15 of prongs 12, 14 may be provided without a taper, or they may be tapered outwardly rather than inwardly, or they may form a tulip-like or other profile. Distal ends 13, 15 can also include openings (not shown) to allow fluid flow at the tip. Openings at the tip, similar to openings on the outer surfaces allow airflow from a blower (not shown) to be vented in a direction generally away from hair within or wrapped around prongs 12, 14. The orifices or vents used to vent air from the styling device at the various locations can be of various shapes and geometries, including round, square or other shaped holes, elongate slots, and so on.

As noted above, prong 12 is equipped with lever 18, which can be depressed by the user to open prongs 12, 14, permitting hair to be placed therebetween. Upon release of lever 18, hair is pressed between prongs 12, 14. With hair between prongs 12, 14 and the desired temperature applied to either or both of prongs 12, 14, hair can be wrapped and styling device 10 pulled along a length of hair (e.g., from near the scalp outward) to heat or cool that length of hair. For example, the hair can be clamped near the scalp by heated inward-facing surfaces 20, 22 and the styling device can be rotated to partially wrap the hair around styling device 10 (e.g., half turn for waves, one full turn for curls). As styling device 10 is pulled down the length of hair, the hair passes through the heated inner surfaces then around either or both outer surfaces (which may also be temperature controlled).

The prongs 12, 14 are biased toward one another in this example with a spring, as described below. Although the illustrated example provides pivotal motion of one prong relative to the body portion (e.g., via a single articulating joint), other implementations may provide pivotal motion of both prongs. For example, both prongs may pivot relative to a body portion, or where there is no body portion, relative to a hinge that joins the two prongs.

A switch, selector, or other actuator may be included with the device to adjust the tension of the spring used with the hinge to maintain the prongs of the device (e.g., prongs 12, 14 in the example of FIG. 1). The embodiment of FIG. 1 shows a portion of such an actuator which in this example is a slide switch. Particularly, FIG. 1 shows a post 52 of the switch that may be slid forward and backward (distal end being forward and a proximal end being rearward) to adjust the spring tension. The switch can be a two-position switch (forward, backward) a multi-position switch with more than two positions, or an un-notched switch with 'infinite' positions. The user may operate the switch by sliding post 52 forward and backward to select the desired amount of pressure user would like prongs 12, 14 to exert when clamping onto the user's hair.

Figure 3A:
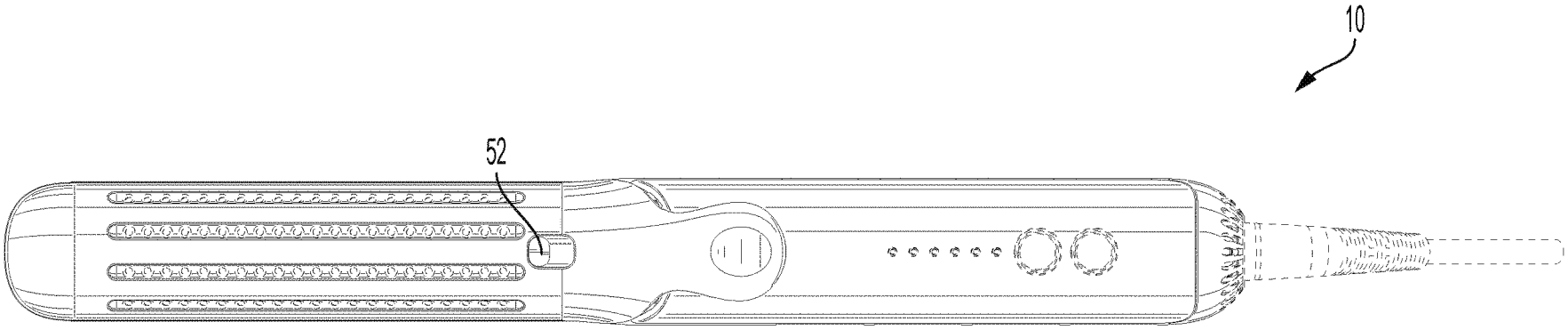
FIGS. 3A and 3B, illustrates top and side views of the example hairstyling tool of FIG. 1.
Figure 3B:
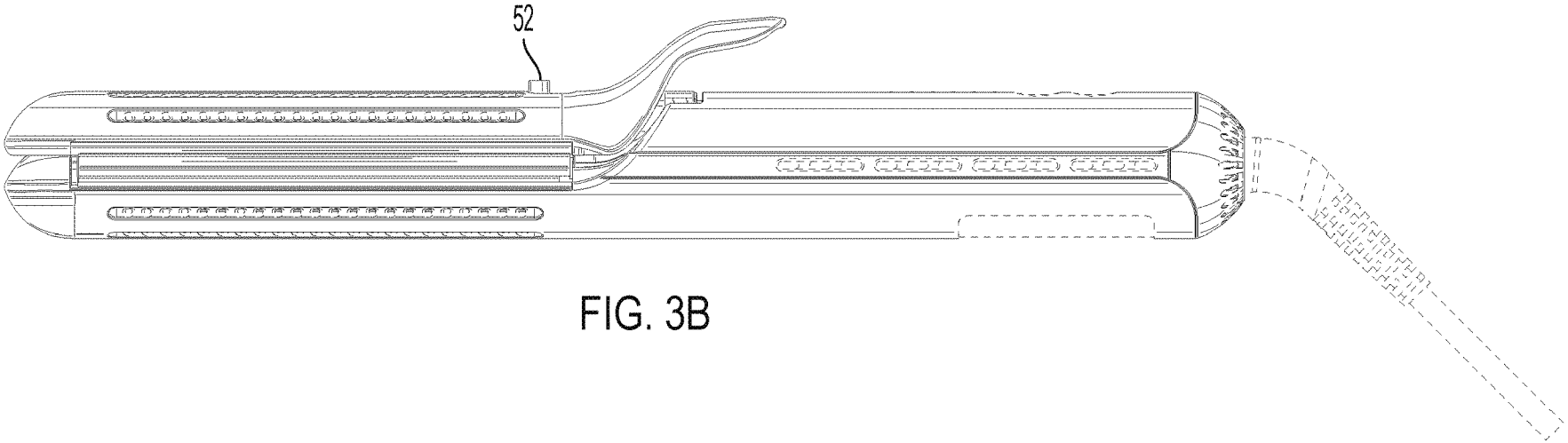

FIG. 3 illustrates top and side views of the example hairstyling tool of FIGS. 1 and 2. Not all elements of the styling device 10 are numbered to reduce clutter and provide clarity. FIG. 3 shows post 52 and an elongate aperture within the outer surface of prong 12 from which post 52 protrudes. Post 52 is part of a tension adjustment actuator 102 (first introduced at FIG. 4 and further described below) used to adjust the amount of pressure that one or more springs applies to prong 12 when clamping down on to prong 14.

Figure 4C:
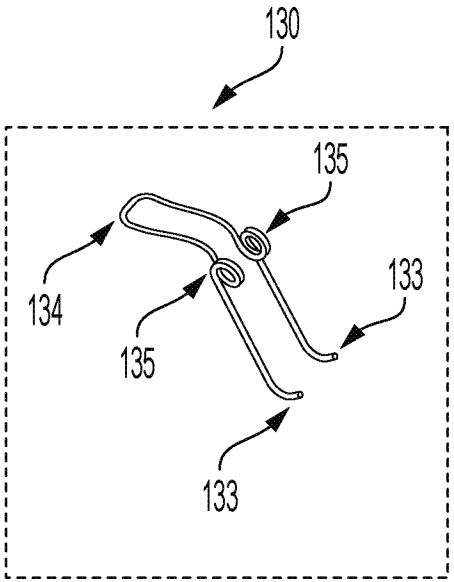
FIG. 4, which comprises FIGS. 4A, 4B, and 4C, provides a cross-sectional view of an example hinge in accordance with various embodiments.
Figure 4A:
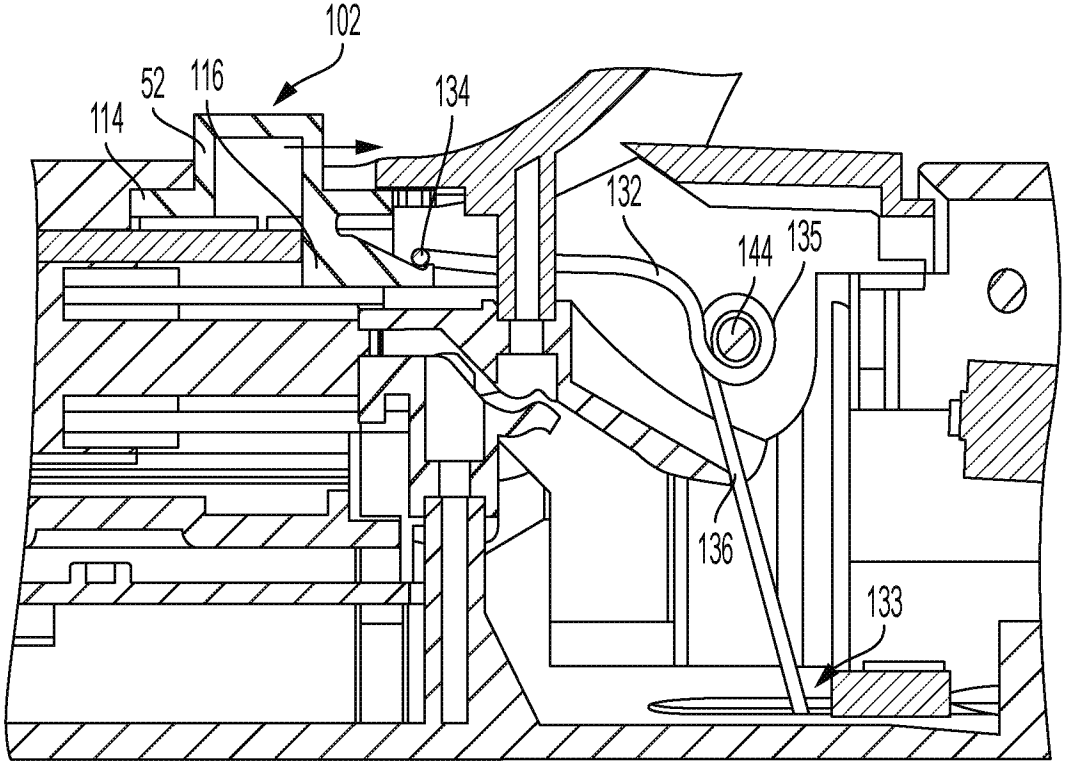
Figure 4B:
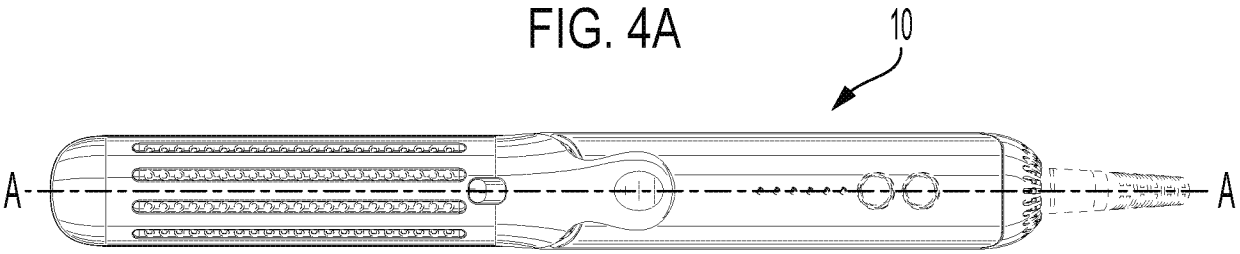

FIG. 4 provides a cross-sectional view of an example hinge in accordance with various embodiments. This view is a longitudinal slice down the center of a two-prong hairstyling tool (such as the example in FIGS. 1 and 2) at centerline A-A as shown. This example includes a tension adjustment actuator 102, implemented as a slide switch that can be actuated by sliding it forward and backward with the user's finger. The hinge in this example includes a spring 130, the entirety of which is shown in the inset at the right of the cross-sectional view, and one 'leg' of which is shown in the cross-sectional view.

Figure 5:
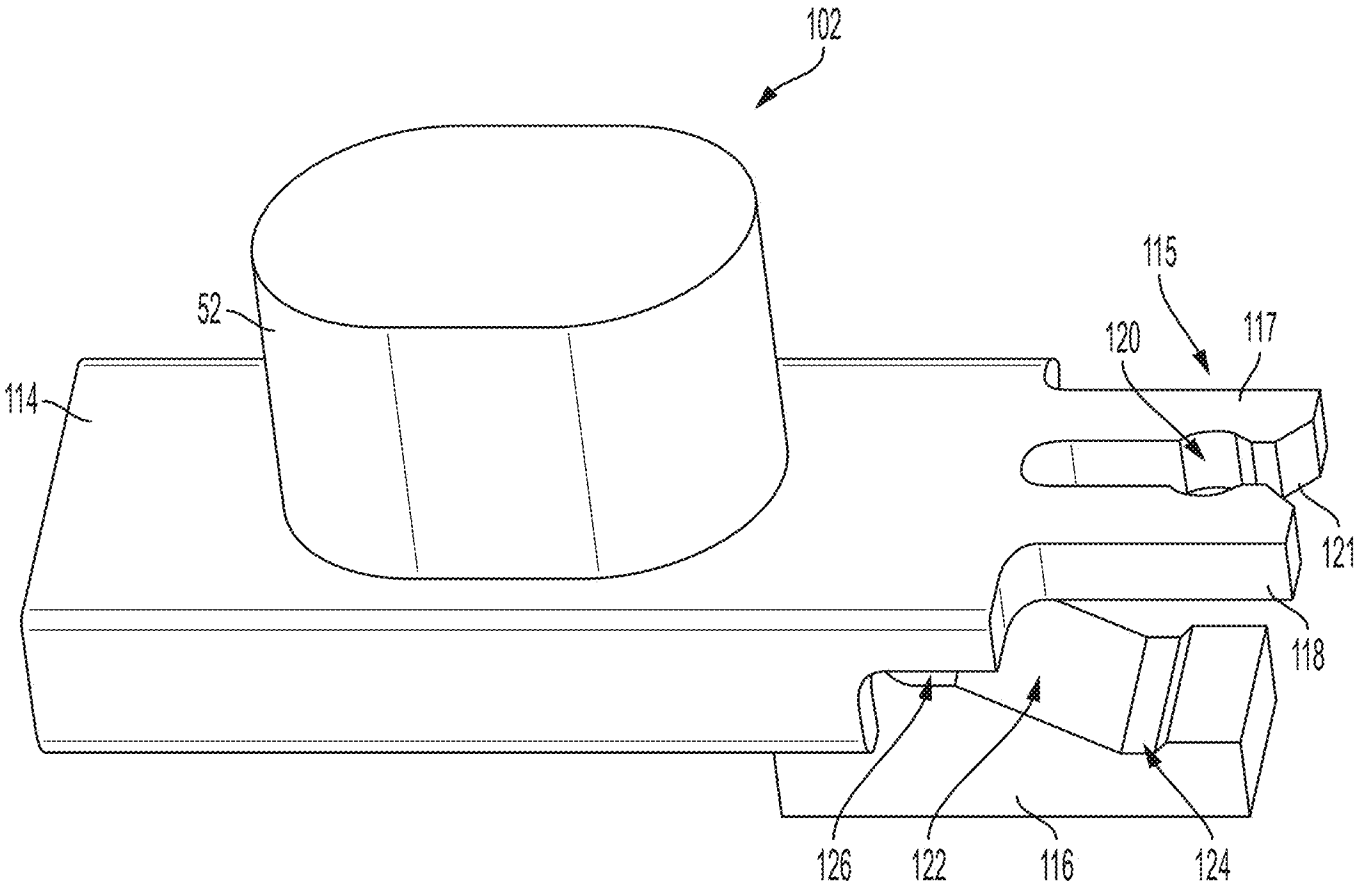
FIG. 5 illustrates a perspective view of an example tension adjustment actuator of FIG. 4.

FIG. 5 illustrates a perspective view of the example tension adjustment actuator 102 of FIG. 4. Referring now to FIGS. 4 and 5, this example shows tension adjustment actuator 102 includes a post 52, a main body 114 with a retaining clip 115 and a ramp member 116. Retaining clip 115 includes two elongate members 117, 118 in spaced-apart relation extending from main body 114. Grooves are formed toward the forward end of elongate members 117, 118 to provide a latch 120. The forward ends of elongate members 117, 118 are tapered or chamfered (chamfered edge 121 is visible) in this example.

Ramp member 116 is an inclined plane that extends below main body 114. Ramp member 116 includes a ramp face 122 that is an inclined plane surface with a detent 124 at the bottom thereof running across the length of ramp member 116. In this example, detent 124 at the lower end of the ramp portion comprises a level surface (level relative to the inclined plane) adjacent a lower end of the inclined plane surface and a lip adjacent the level surface. Detent 124 may have a geometry and depth to provide tactile feedback to user, such as when the user reaches the full forward position and when the user is moving post 52 back from the full forward position.

Figure 10B:
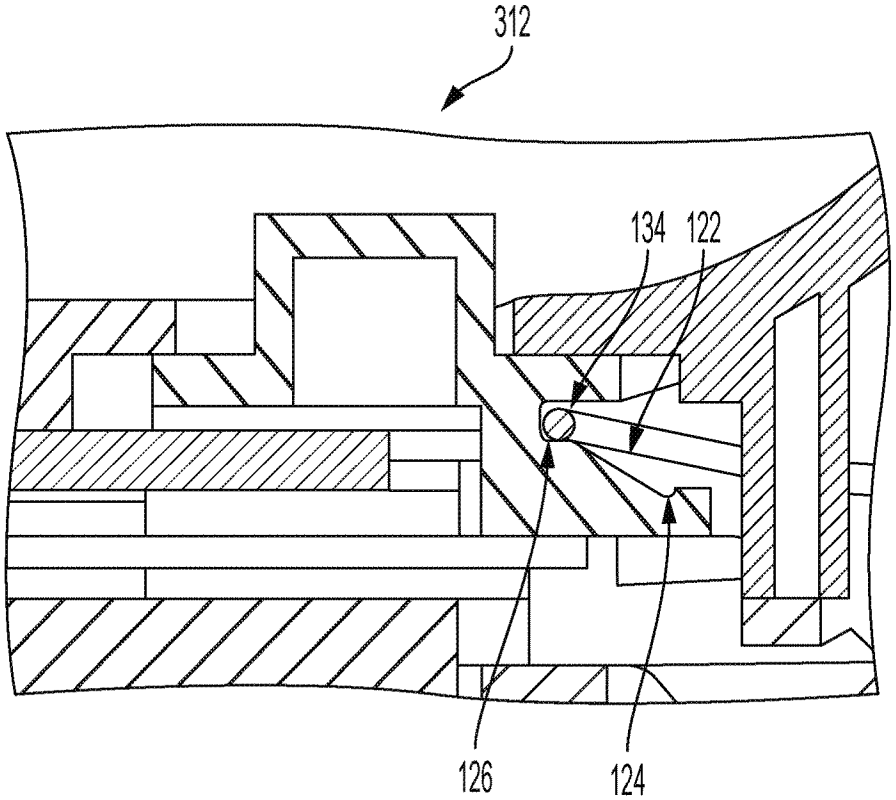
FIGS. 10A and 10B, illustrates close-up views of the tension adjustment actuator of FIG. 9.
Figure 10A:
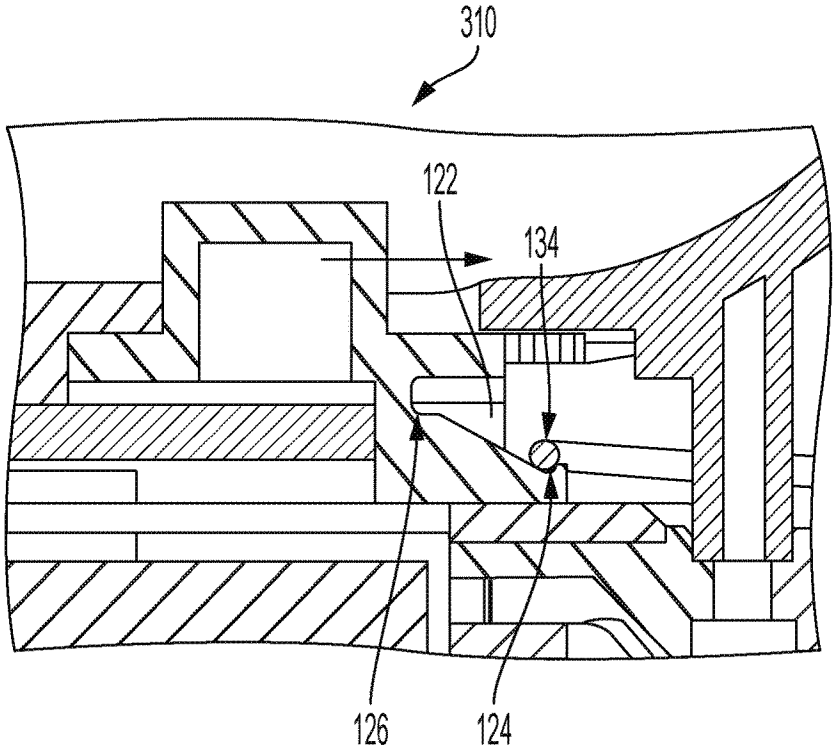

At the top of ramp face 122 is a receiving groove 126 (see FIG. 10). Receiving groove 126 is formed as a groove at a top of the ramp portion with a level bottom surface that extends into the rear surface of main body 114. The top face of post 52 in the illustrated example is knurled to provide a better grip for actuating the switch. In other embodiments, the top face of post 52 may be knurled, grooved or otherwise textured, or it may be substantially smooth.

With focus returning to FIG. 4, the configuration and spatial relation of tension adjustment actuator 102 and spring 130 is shown. Because FIG. 4 is a cutaway view only one half of tension adjustment actuator 102 and spring 130 are shown. The inset at FIG. 4 on the right shows an example of spring 130 in its entirety. In this example, spring 130 is a double torsion spring that includes two helical coils 135 and two legs 136 extending downward from helical coils 135, each leg 136 terminating in a leg base 133. At the other end, arms 132 extend from helical coils 135 and are connected by a bridge 134. Bridge 134 helps ensure that helical coils 135 work in parallel and provides balanced torque and stability to the system. As described further below, bridge 134 is also the structural member by which external forces are applied to spring 130 to adjust the amount of retention applied. Using two helical coils 135 wound in opposite directions around a common axis allows the spring to provide additional torque at the same twist angle as compared to a single torsion spring with the same number of windings as a single helical coil 135.

Figure 6:
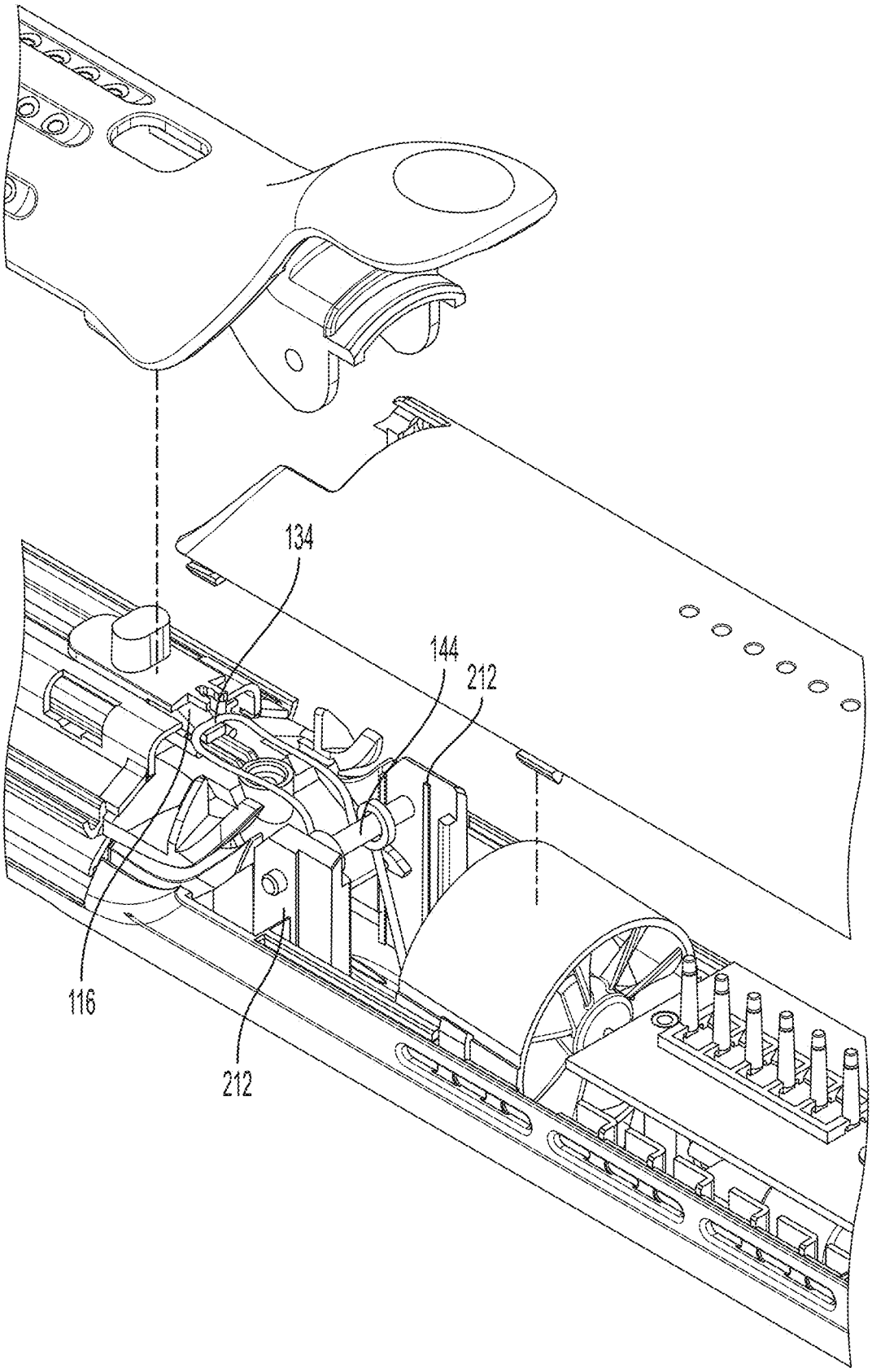
FIG. 6 is a close-up partially exploded view of a hairstyling device that illustrates an implementation of the example switch and spring mechanism of FIGS. 4 and 5.
Figure 7:
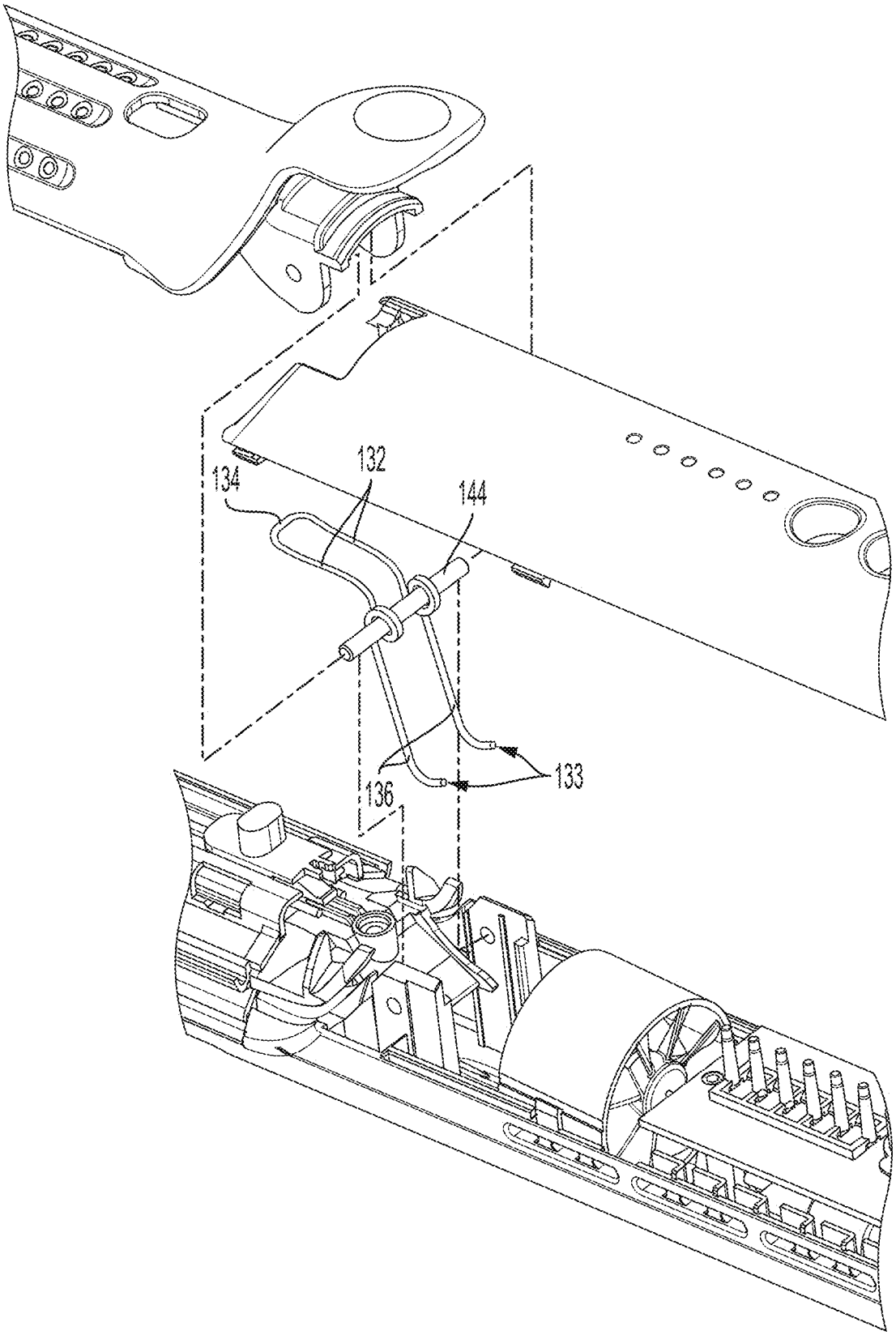
FIG. 7 is another partially exploded view that illustrates the spring and pivot post exploded from the assembly.
Figure 8:
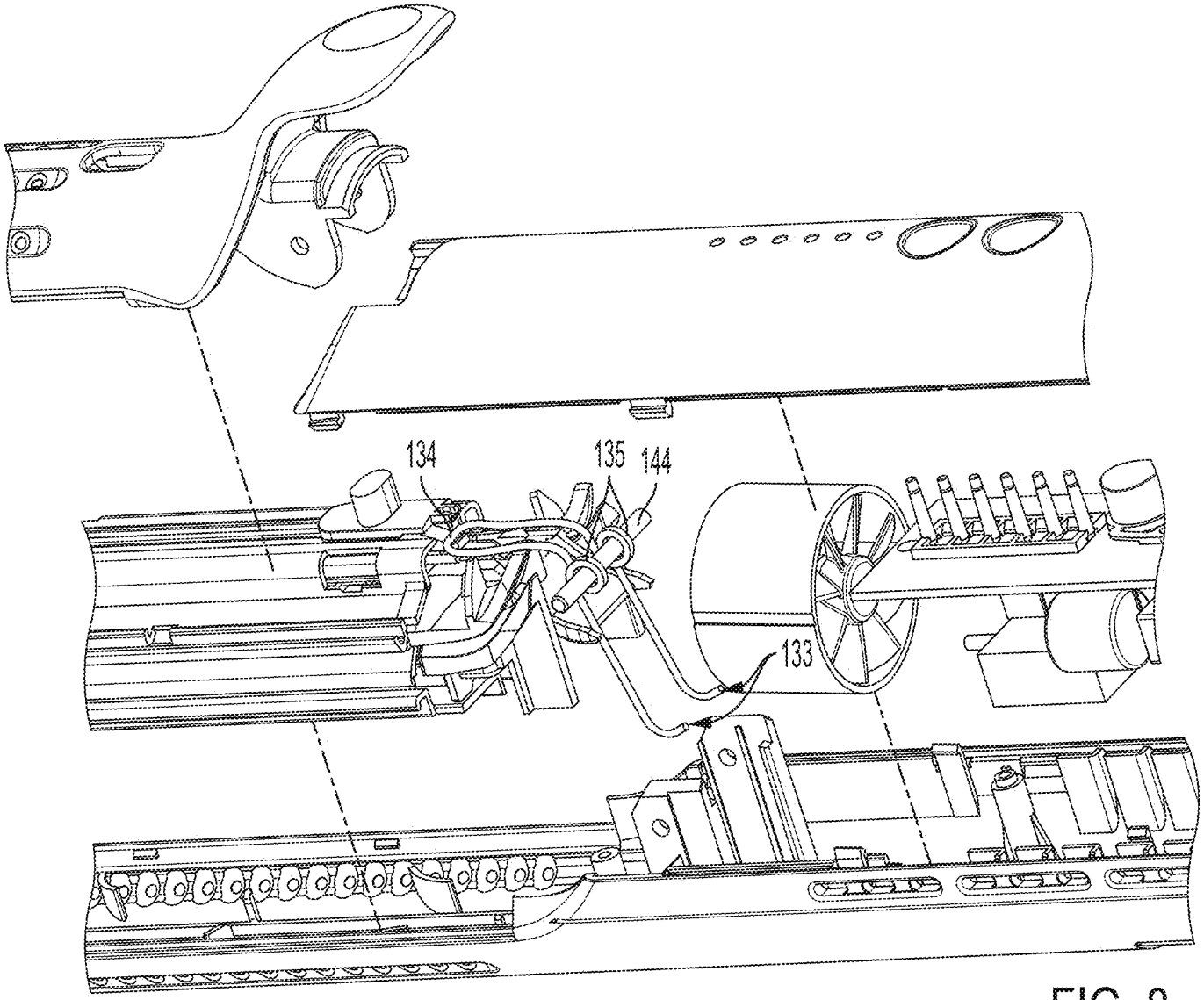
FIG. 8 is another partially exploded view of the example spring mechanism of FIGS. 6 and 7.

FIG. 6 is a close-up partially exploded view of a hair-styling device that illustrates an implementation of the example switch and spring mechanism of FIGS. 4 and 5. FIG. 7 is another partially exploded view that illustrates the spring and pivot post 144 exploded from the assembly. FIG. 8 is another partially exploded view of the example spring mechanism of FIGS. 6 and 7. With reference now to FIGS. 4 through 8, operation of this example spring mechanism is described.

Mounting members 212 within handle 16 extend from the inner surface of the base of handle 16 in an upward direction. Pivot post 144 is a shaft that extends through both helical coils 135 of spring 130 and also through apertures in mounting members 212, where it is held in place at each end. Thus, pivot post 144 provides a common axis for helical coils 135 and a solid and stable pivot point for spring 130. As also seen in FIGS. 6 and 9, bridge 134 of spring 130 rests on ramp member 116. As illustrated, when tension adjustment actuator 102 is in the forward position, bridge 134 of spring 130 rests in detent 124 of ramp member 116.

As also seen, legs 136 extend downward from helical coils 135 at pivot post 144 toward the inner surface of the base of handle 16. The leg bases 133 rest in spring mounting channels at the bottom of the interior of handle 16. These channels (not shown) may be shaped to hold leg bases 133 in place so that they do not move laterally or longitudinally. For example, they can be channels formed as a gap between two spaced-apart parallel bar structures extending from the inner surface of the base of handle 16. As another example, the channels may be grooves formed in the inner surface of the base of handle 16.

In operation, the user depressing lever 18 lifts prong 12, applying upward pressure on bridge 134. This is resisted by the torsional force applied by helical coils 135. When lever 18 is released, the torsional force of helical coils 135 applies downward force on bridge 134, forcing prong 12 back down toward prong 14.

Figure 9B:
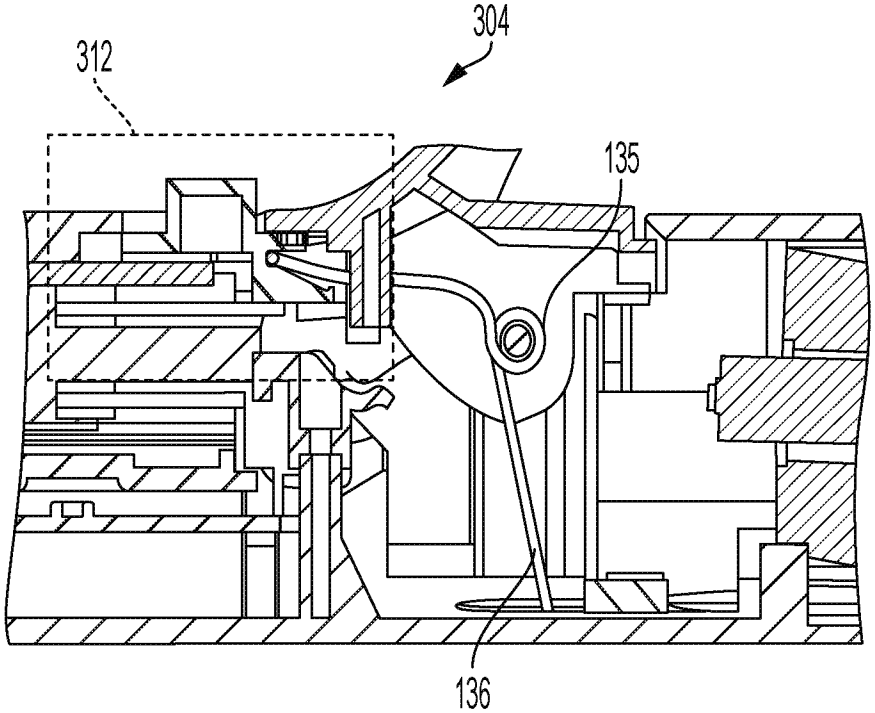
FIGS. 9A and 9B, illustrates the example tension adjustment actuator in two different positions.
Figure 9A:
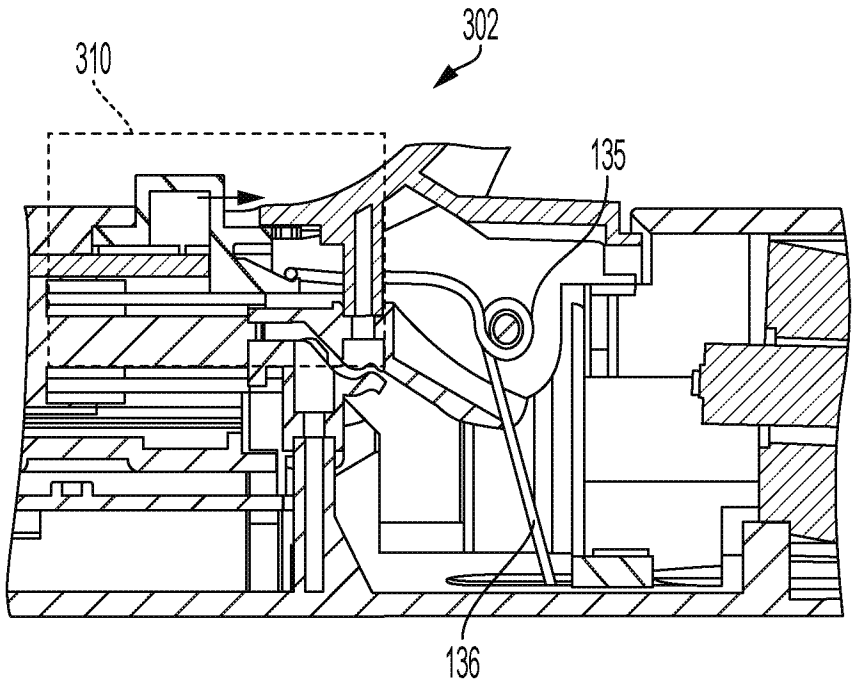

FIG. 9 illustrates tension adjustment actuator 102 in two different positions (FIG. 9A and FIG. 9B). FIG. 10 illustrates a close-up view of the actuators of FIG. 9, as called out by views 310 and 312. Referring now to FIGS. 9 and 10, view 302 of FIGS. 9 and 10 illustrates tension adjustment actuator 102 in the forward position (pushed toward the distal end of prong 12). This is the same position as shown in FIG. 4. View 304 of FIGS. 9 and 10 illustrates tension adjustment actuator 102 in the rearward position (pushed toward the proximal end of prong 12).

Referring to view 302 of FIGS. 9 and 10 and to FIG. 4, with tension adjustment actuator 102 in the forward position as shown, bridge 134 of spring 130 rests in detent 124 at the bottom of ramp face 122. In this position, spring 130 applies downward pressure to prong 12 at a force of a first determined magnitude. Detent 124 may be positioned to provide a stop for forward motion of tension adjustment actuator 102 in the event there is play between post 52 and the front wall of the elongate aperture in prong 12 through which post 52 extends. In this example, detent 124 at the lower end of the ramp portion comprises a radiused lip at a lower end of the inclined plane surface of the ramp portion dimensioned to accept bridge 134 of the torsion spring. Detent 124 provides a stop and provides tactile feedback to a user, such as when the user reaches the full forward position.

The aperture in prong 12 is shown as an elongate aperture to allow post 52 to slide forward and backward within the aperture. Other aperture geometries and dimensions may be implemented depending on the geometry and operation of the tension adjustment actuator 102.

Referring to view 304 of FIGS. 9 and 10, with post 52 of tension adjustment actuator 102 slid back to the rearward position, bridge 134 of spring 130 rests in groove 126 at the top end of ramp face 122. This applies additional tension to spring 130. With the slider in this position, spring 130 applies downward pressure to prong 12 at a force of a second determined magnitude. The second determined magnitude is a greater amount of force than the first determined magnitude due to the pre-tensioning applied to spring 130 in this position. The front wall of groove 126 may be positioned to provide a stop for rearward motion of post 52 of tension adjustment actuator 102 in the event there is play between post 52 and the rear wall of the elongate aperture in prong 12 through which post 52 extends. Detent 124 may have a geometry and depth to provide tactile feedback to user, such as when the user reaches the full rearward position and when the user is moving post 52 forward from the full rearward position.

Figure 11B:
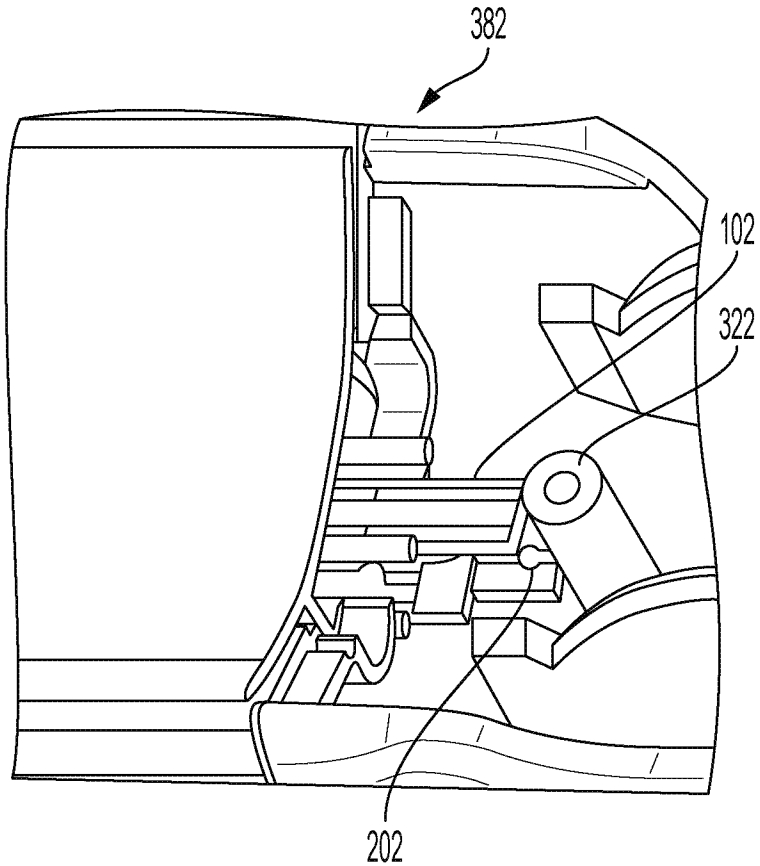
FIGS. 11A and 11B, illustrates an example of a locking pin in accordance with various embodiments.
Figure 11A:
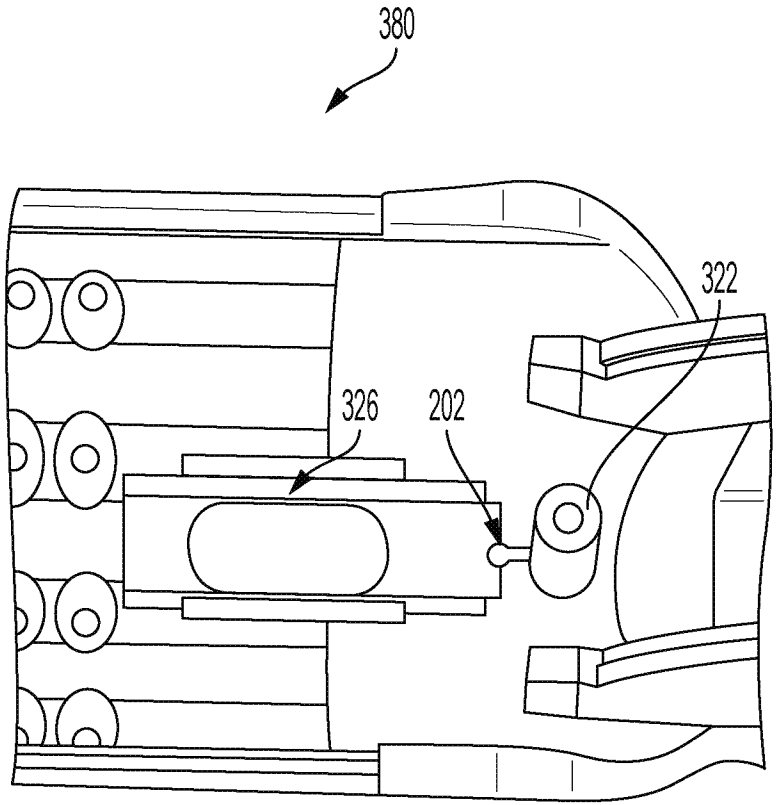

As noted above with reference to FIG. 5, grooves are formed toward the forward end of elongate members 117, 118 to provide a latch 120. These engage with a form of locking pin on or at the upper inner surface of prong 12 to help lock tension adjustment actuator 102 in place when in the rearward position. FIG. 11 illustrates an example of a locking pin in accordance with various embodiments. In this example, locking pin 202 is formed as a cylindrical element or a ball at the end of an elongate member attached to a post 322. The ball is dimensioned to separate elongate members 117, 118 by pressure applied at their chamfered edges. Once locking pin 202 is positioned at latch 120, elongate members 117, 118 'snap' back into place, engaging with and providing a hold on locking pin 202. View 380 of FIG. 11 shows an example of locking pin 202 extending from post 322 toward elongate aperture 326. View 382 of FIG. 11 shows an example of locking pin 202 extending from post 322 into, and engaging with, latch 120 of elongate members 117, 118 of tension adjustment actuator 102.

Example Embodiment A: A hairstyling tool, may include: a body portion; a first prong extending from the body portion in a first direction and may include a temperature-controlled element and an elongate aperture in a top surface of the prong, where a proximal end of the first prong is pivotally attached to the body portion via a hinge; a second prong extending from the body portion in the first direction; two spring mounting channels in a base of the body portion; a double torsion spring may include first and second torsion springs wound around a common axis and connected by a bridge, and one leg extending from each of the first and second torsion springs, the double torsion spring positioned to apply pressure on a proximal end of the first prong to maintain the first prong in a closed position relative to the second prong; and a tension adjustment actuator may include: a main body portion, a post extending from a first surface of the main body portion through the elongate aperture in the first prong, and a ramp portion extending from a first end of the body portion, the ramp portion may include an inclined plane surface and a detent at the lower end of the ramp portion and a groove at a top of the ramp portion and extending into a rear surface of the main body portion adjacent; where the double torsion spring is positioned such that each leg of the spring rests in a corresponding spring mounting channel in the base of the body portion and the bridge is in contact with the ramp portion; and further where, when pressure is applied by a user to move the post to the rear of the elongate aperture, the ramp is translated longitudinally rearward and the bridge of the double torsion spring rises along the inclined plane surface to be positioned in the groove, and spring tension is at a first amount; and when pressure is applied by a user to move the post to a front of the elongate aperture, the ramp is translated forward and the bridge of the double torsion spring is positioned in the detent and spring tension is at a second amount, where the second amount of spring tension is less than the first amount of spring tension.

Example Embodiment B: The hairstyling tool of Example Embodiment A further may include first and second parallel elongate members extending from the body portion in spaced-apart relation and may include grooves formed in inner edges of the first and second elongate members to provide a latch.

Example Embodiment C: The hairstyling tool of Example Embodiment B, where forward ends of the first and second elongate members are chamfered.

Example Embodiment D: The hairstyling tool of any one of Example Embodiments B-C, further may include a locking pin at an inner surface of the first prong dimensioned to engage within the latch, where, upon sliding the post rearward a sufficient amount for the first and second parallel elongate members to contact the locking pin, chamfered edges of the first and second parallel elongate members contact the locking pin, which, upon further sliding of the post rearward cause the second parallel elongate members to spread apart to accept the locking pin between the first and second parallel elongate members.

Example Embodiment E: The hairstyling tool of any one of Example Embodiments B-D, where upon further sliding the post rearward the locking pin is engaged within the latch.

Example Embodiment F: The hairstyling tool of any one of Example Embodiments B-D, where the locking pin is a cylindrical post or a ball.

Example Embodiment G: The hairstyling tool of Example Embodiment A, where the first and second torsion springs are wound about a common shaft in opposite directions from one another.

Example Embodiment H: The hairstyling tool of Example Embodiment A, where the detent at the lower end of the ramp portion may include a level surface adjacent a lower end of the inclined plane surface and a lip adjacent the level surface.

Example Embodiment I: The hairstyling tool of Example Embodiment A, where the detent at the lower end of the ramp portion may include a radiused lip at a lower end of the inclined plane surface of the ramp portion.

Example Embodiment J: The hairstyling tool of Example Embodiment A, where each leg of the torsion spring terminates in a leg base, and the leg base of each leg rests in the corresponding spring mounting channel in the base of the body portion.

Example Embodiment K: A hairstyling tool, may include: a body portion; a first prong extending from the body portion in a first direction and may include a proximal end pivotally attached to the body portion via a hinge; a second prong extending from the body portion in the first direction; a double torsion spring may include first and second torsion springs connected by a bridge, the double torsion spring positioned to apply pressure on a proximal end of the first prong; and an inclined plane movable longitudinally, where, when the inclined plane is moved forward, the bridge of the double torsion spring is positioned in a detent at a rear end of the inclined plane, and spring tension is at a first amount; and when the inclined plane is moved rearward, the bridge of the double torsion spring is positioned in a groove and spring tension is at a second amount, where the second amount of spring tension is greater than the first amount of spring tension.

Example Embodiment L: The hairstyling tool of Example Embodiment K further may include first and second parallel elongate members arranged in spaced apart relation and extending rearward above the inclined plane, the first and second parallel elongate members may include grooves formed in inner edges thereof to provide a latch.

Example Embodiment M: The hairstyling tool of Example Embodiment L, where the forward ends of the first and second elongate members are chamfered.

Example Embodiment N: The hairstyling tool of any one of Example Embodiments L-M, further may include a locking pin at an inner surface of the first prong dimensioned to engage within the latch when the inclined plane is moved rearward.

Example Embodiment O: The hairstyling tool of any one of Example Embodiments L-N, where the locking pin is a cylindrical post or a ball.

Example Embodiment P: The hairstyling tool of Example Embodiment K, where the first and second torsion springs are wound about a common shaft in opposite directions from one another.

Example Embodiment Q: The hairstyling tool of Example Embodiment K further may include a detent at the lower end of the inclined plane, where the detent may include a level surface adjacent a lower end of the inclined plane and a lip adjacent the level surface.

Example Embodiment R: The hairstyling tool of Example Embodiment K further may include a detent at the lower end of the inclined plane, where the detent may include a radiused lip at a lower end of the inclined plane surface of the inclined plane.

Example Embodiment S: The hairstyling tool of Example Embodiment K, where double torsion spring may include two legs and each leg terminates in a leg base, and the leg base of each leg rests in a corresponding spring mounting channel in the body portion.

In this document, the terms "approximately" and "substantially" are used to account for variations that may occur due to manufacturing tolerances, measurement inaccuracies, and other practical considerations in implementing the described technology. The term "approximately" refers to a value or range that is close to the stated value but allows for minor deviations, typically within ±10%, unless otherwise specified, that do not materially affect the function or purpose of the invention. Similarly, the term "substantially" is used to indicate that a particular feature, characteristic, or result is largely present or achieved, with allowable variations without deviating from the intended scope and function of the invention. These terms should be interpreted in a manner consistent with the understanding of a person skilled in the art.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

What is claimed is:

1. A hairstyling tool, comprising:

a body portion;

a first prong extending from the body portion in a first direction and comprising a temperature-controlled element and an elongate aperture in a top surface of the prong, wherein a proximal end of the first prong is pivotally attached to the body portion via a hinge;

a second prong extending from the body portion in the first direction;

two spring mounting channels in a base of the body portion;

a double torsion spring comprising first and second torsion springs wound around a common axis and connected by a bridge, and one leg extending from each of the first and second torsion springs, the double torsion spring positioned to apply pressure on a proximal end of the first prong to maintain the first prong in a closed position relative to the second prong; and a tension adjustment actuator comprising:

a main body portion, a post extending from a first surface of the main body portion through the elongate aperture in the first prong, and a ramp portion extending from a first end of the body portion, the ramp portion comprising an inclined plane surface and a detent at the lower end of the ramp portion and a groove at a top of the ramp portion and extending into a rear surface of the main body portion adjacent;

wherein the double torsion spring is positioned such that each leg of the first and second torsion spring rests in the corresponding spring mounting channel in the base of the body portion and the bridge is in contact with the ramp portion; and further wherein, when pressure is applied by a user to move the post to the rear of the elongate aperture, the ramp is translated longitudinally rearward and the bridge of the double torsion spring rises along the inclined plane surface to be positioned in the groove, and spring tension is at a first amount; and when pressure is applied by a user to move the post to a front of the elongate aperture, the ramp is translated forward and the bridge of the double torsion spring is positioned in the detent and the spring tension is at a second amount, wherein the second amount of spring tension is less than the first amount of spring tension.

2. The hairstyling tool of claim 1, further comprising first and second parallel elongate members extending from the main body portion in spaced-apart relation and comprising grooves formed in inner edges of the first and second elongate members to provide a latch.

3. The hairstyling tool of claim 2, wherein forward ends of the first and second elongate members are chamfered.

4. The hairstyling tool of claim 3, further comprising a locking pin at an inner surface of the first prong dimensioned to engage within the latch, wherein, upon sliding the post rearward a sufficient amount for the first and second parallel elongate members to contact the locking pin, chamfered edges of the first and second parallel elongate members contact the locking pin, which, upon further sliding of the post rearward cause the second parallel elongate members to spread apart to accept the locking pin between the first and second parallel elongate members.

5. The hairstyling tool of claim 4, wherein upon further sliding the post rearward the locking pin is engaged within the latch.

6. The hairstyling tool of claim 4, wherein the locking pin is a cylindrical post or a ball.

7. The hairstyling tool of claim 1, wherein the first and second torsion springs are wound about a common shaft in opposite directions from one another.

8. The hairstyling tool of claim 1, wherein the detent at the lower end of the ramp portion comprises a level surface adjacent a lower end of the inclined plane surface and a lip adjacent the level surface.

9. The hairstyling tool of claim 1, wherein the detent at the lower end of the ramp portion comprises a radiused lip at a lower end of the inclined plane surface of the ramp portion.

10. The hairstyling tool of claim 1, wherein each leg of the torsion spring terminates in a leg base, and the leg base of each leg rests in the corresponding spring mounting channel in the base of the body portion.

11. A hairstyling tool, comprising:

a body portion;

a first prong extending from the body portion in a first direction and comprising a proximal end pivotally attached to the body portion via a hinge;

a second prong extending from the body portion in the first direction;

a double torsion spring comprising first and second torsion springs connected by a bridge, the double torsion spring positioned to apply pressure on a proximal end of the first prong; and an inclined plane movable longitudinally, wherein, when the inclined plane is moved forward, the bridge of the double torsion spring is positioned in a detent at a rear end of the inclined plane, and spring tension is at a first amount; and when the inclined plane is moved rearward, the bridge of the double torsion spring is positioned in a groove and the spring tension is at a second amount, wherein the second amount of spring tension is greater than the first amount of spring tension.

12. The hairstyling tool of claim 11, further comprising first and second parallel elongate members arranged in spaced apart relation and extending rearward above the inclined plane, the first and second parallel elongate members comprising grooves formed in inner edges thereof to provide a latch.

13. The hairstyling tool of claim 12, wherein the forward ends of the first and second elongate members are chamfered.

14. The hairstyling tool of claim 13, further comprising a locking pin at an inner surface of the first prong dimensioned to engage within the latch when the inclined plane is moved rearward.

15. The hairstyling tool of claim 14, wherein the locking pin is a cylindrical post or a ball.

16. The hairstyling tool of claim 11, wherein the first and second torsion springs are wound about a common shaft in opposite directions from one another.

17. The hairstyling tool of claim 11, further comprising a detent at the lower end of the inclined plane, wherein the detent comprises a level surface adjacent a lower end of the inclined plane and a lip adjacent the level surface.

18. The hairstyling tool of claim 11, further comprising a detent at the lower end of the inclined plane, wherein the detent comprises a radiused lip at a lower end of the inclined plane surface of the inclined plane.

19. The hairstyling tool of claim 11, wherein double torsion spring comprising two legs and each leg terminates in a leg base, and the leg base of each leg rests in a corresponding spring mounting channel in the body portion.

* * * * *